US007909066B2

(12) United States Patent
Wada

(10) Patent No.: US 7,909,066 B2
(45) Date of Patent: Mar. 22, 2011

(54) METHOD FOR WEAVING LAYERED BEADED FABRIC AND BEADED FABRIC WOVEN BY THE METHOD

(76) Inventor: Keiko Wada, Odawara (JP)

( * ) Notice: Subject to any disclaimer, the term of this patent is extended or adjusted under 35 U.S.C. 154(b) by 0 days.

(21) Appl. No.: 12/658,076

(22) Filed: Feb. 2, 2010

(65) Prior Publication Data

US 2010/0206422 A1 Aug. 19, 2010

(30) Foreign Application Priority Data

Feb. 19, 2009 (JP) ..... 2009-036529

(51) Int. Cl.
*D03D 29/00* (2006.01)
*D03D 23/00* (2006.01)

(52) U.S. Cl. ..... 139/29; 139/1 R; 139/30; 139/31; 139/32; 139/33

(58) Field of Classification Search ..... 139/1 R, 139/29–33, 33.5, 34
See application file for complete search history.

(56) References Cited

U.S. PATENT DOCUMENTS

| | | | | | |
|---|---|---|---|---|---|
| 538,022 | A | * | 4/1895 | Lapworth | 139/199 |
| 737,073 | A | * | 8/1903 | Bush | 28/151 |
| 1,980,666 | A | * | 11/1934 | Crompton, Jr. | 139/1 R |
| 1,995,384 | A | * | 3/1935 | Fletcher | 28/151 |
| 2,043,082 | A | * | 6/1936 | Wallach | 28/151 |
| 2,094,505 | A | * | 9/1937 | Thackeray | 139/33 |
| 2,110,822 | A | * | 3/1938 | Roberts | 139/33 |
| 2,139,879 | A | * | 12/1938 | Clark et al. | 139/33 |
| 2,150,187 | A | * | 3/1939 | Raba et al. | 139/33 |
| 2,209,597 | A | * | 7/1940 | Clark et al. | 139/33 |
| 2,224,563 | A | * | 12/1940 | Clark | 139/33 |
| 2,241,318 | A | * | 5/1941 | Robson | 139/33 |
| 2,346,541 | A | * | 4/1944 | Owen et al. | 139/33 |
| 2,504,940 | A | * | 4/1950 | Wallach | 28/151 |
| 2,601,222 | A | * | 6/1952 | Wehrli | 28/151 |
| 2,641,389 | A | * | 6/1953 | Bagdon | 223/48 |
| 2,670,109 | A | * | 2/1954 | Perry et al. | 223/48 |
| 2,707,316 | A | * | 5/1955 | Doniger | 28/151 |
| 2,769,461 | A | * | 11/1956 | Kaufmann | 139/92 |
| 2,802,255 | A | * | 8/1957 | Wallach | 28/151 |
| 2,903,019 | A | * | 9/1959 | Knopf | 139/29 |
| 3,636,987 | A | * | 1/1972 | Forby | 28/151 |
| 3,692,068 | A | * | 9/1972 | Auer et al. | 139/116.1 |
| 3,724,041 | A | * | 4/1973 | Cleverley | 28/149 |
| 3,879,823 | A | * | 4/1975 | Lamb | 28/147 |
| 4,046,171 | A | * | 9/1977 | Wilson | 139/29 |
| 5,494,734 | A | * | 2/1996 | Widders | 442/2 |
| 5,664,707 | A | * | 9/1997 | Spector | 223/48 |
| 6,065,504 | A | * | 5/2000 | Sidore | 139/29 |

(Continued)

FOREIGN PATENT DOCUMENTS

JP 10/085012 4/1998

(Continued)

*Primary Examiner* — Bobby H Muromoto, Jr.
(74) *Attorney, Agent, or Firm* — James Creighton Wray

(57) ABSTRACT

Two layered beads (B) arranged between two neighboring warps ($t_{x-1}$) and ($t_x$) are woven by inserting a weft ($y_x$) through center holes (2) of the beads in (B) in a forward direction or in a backward direction and turning the weft ($y_x$), around one of the warps (t). A two layered beaded fabric is obtained by repeating the movements of the weft ($y_x$). A three layered beaded fabric can be obtained in the same manner as the two layered beaded fabric.

4 Claims, 9 Drawing Sheets

U.S. PATENT DOCUMENTS

| | | | | |
|---|---|---|---|---|
| 6,719,013 | B1 * | 4/2004 | D'Estais | 139/29 |
| 7,147,008 | B2 * | 12/2006 | Sayler | 139/29 |
| 7,677,273 | B2 * | 3/2010 | Skaflestad | 139/29 |
| 7,762,284 | B2 * | 7/2010 | Ricks | 139/29 |
| 2004/0069363 | A1 * | 4/2004 | D'Estais | 139/1 R |
| 2005/0247745 | A1 * | 11/2005 | Spor et al. | 223/48 |
| 2006/0157137 | A1 * | 7/2006 | Sayler | 139/29 |
| 2008/0173368 | A1 * | 7/2008 | Flodin et al. | 139/33 |
| 2009/0293982 | A1 * | 12/2009 | Skaflestad | 139/34 |

FOREIGN PATENT DOCUMENTS

| | | |
|---|---|---|
| JP | 2000/355848 | 12/2000 |
| JP | 2008/007866 | 1/2008 |

* cited by examiner

FIG. 1-2
(f)
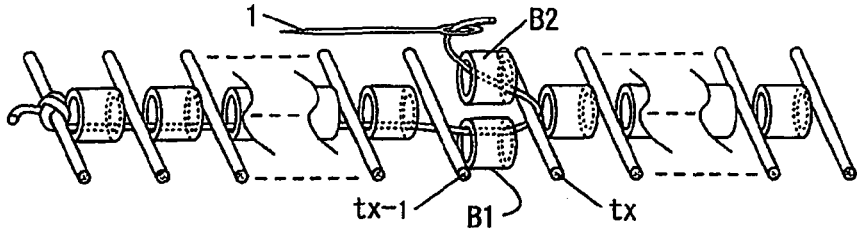
(g)
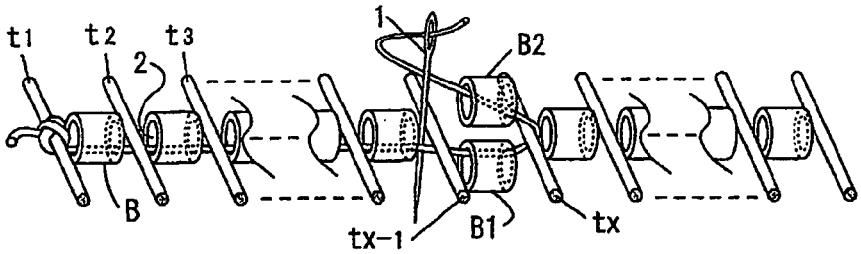
(h)
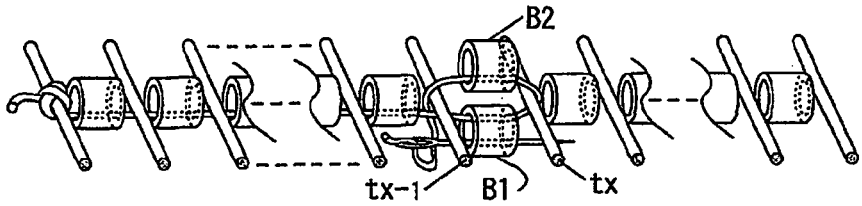
(i)
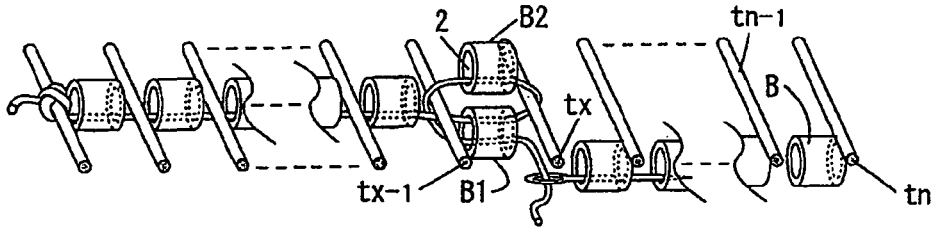
(j)
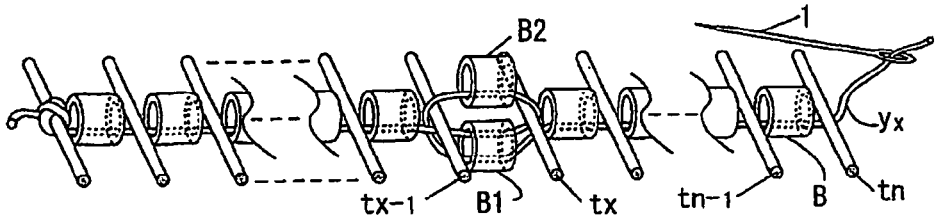

FIG. 1-3
(k)
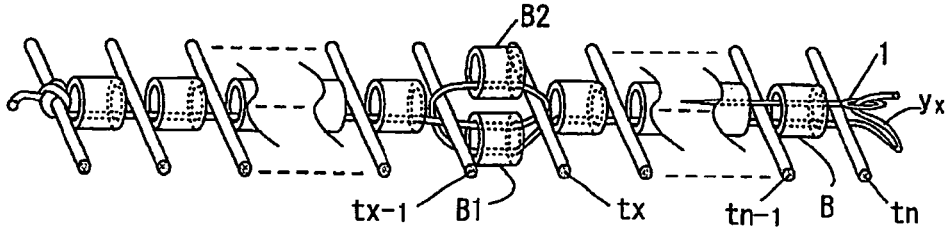
(l)
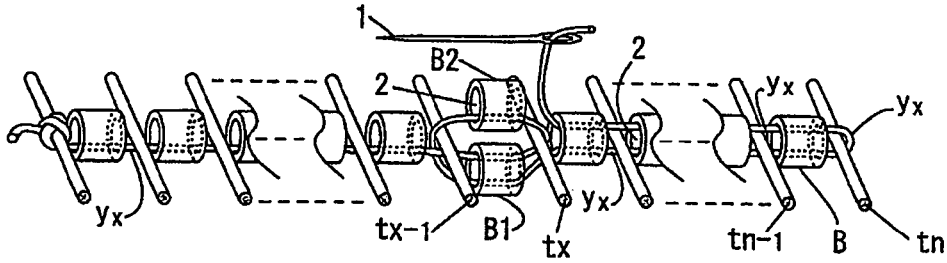
(m)
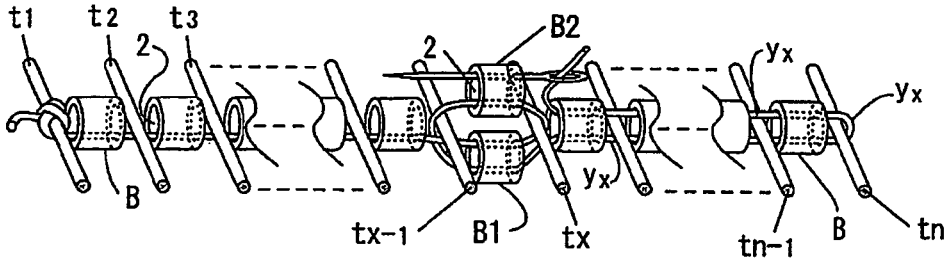
(n)
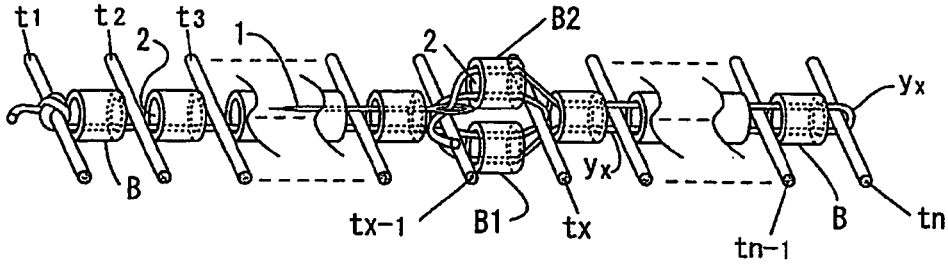
(o)
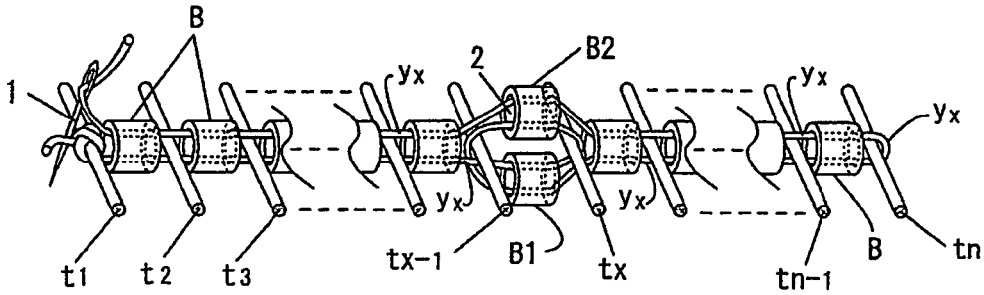

(e)

(f)

(g)

(h)

FIG. 2-3
(i)
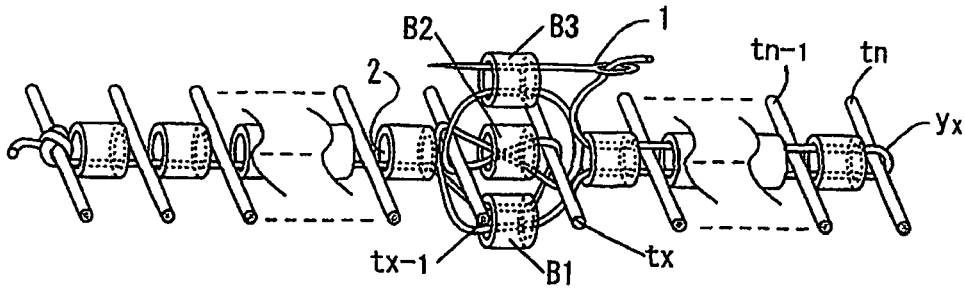
(j)
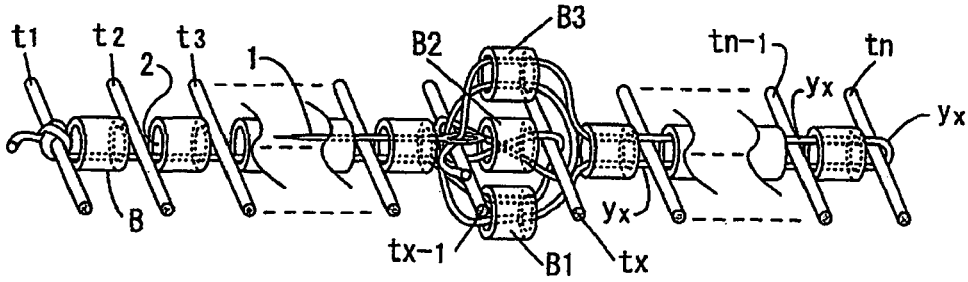
(k)
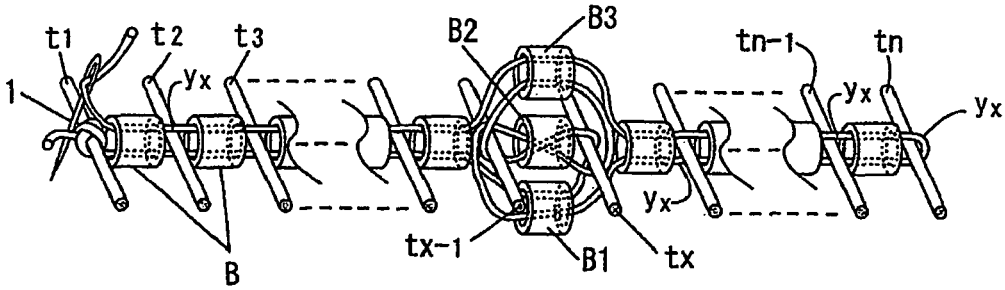

(a)

(b)

(c)

METHOD FOR WEAVING LAYERED BEADED FABRIC AND BEADED FABRIC WOVEN BY THE METHOD

This application claims the benefit of Japanese Application No. 2009-36529 filed Feb. 19, 2009, which is hereby incorporated by reference in its entirety as if fully set forth herein.

BACKGROUND OF THE INVENTION

1. Field of the Invention

The present invention relates to a method for weaving two or three layered beaded fabric having a three-dimensional pattern thereon and relates to layered beaded fabrics woven by the method.

2. Brief Description of the Related Art

Woven beaded fabrics have a long history. Various kinds of beads made of such as glass, shell and the like have been employed, so that the beaded fabrics with various kinds of patterns have been woven up to now.

Looms for handicraft beaded fabrics (for example see reference 1) using threads, methods for weaving such as beaded fabrics (for example see reference 2) and the like are widely known nowadays.

In addition to two dimensional beaded fabrics provided by such looms and methods, methods for weaving three-dimensional beaded fabrics (for example see reference 3) are also widely known.

In the method disclosed in reference 3, a three-dimensional beaded fabric is provided by adhering a differently prepared beaded fabric to a two-dimensional beaded fabric, which means the three-dimensional bead fabric provided by this method does not have a smooth continuing feeling. Such smooth continuing feeling is provided, when one thread employed as a warp or a weft is woven into a three-dimensional beaded fabric. Consequently, a finished three-dimensional beaded fabric by the method in reference 3 gives a somewhat awkward feeling, so that a three-dimensional beaded fabric of high quality cannot be expected by this method.

[References]

Reference 1: Japanese laid open Patent No. 2000-355848
Reference 2: Japanese laid open Patent No. 2008-7866
Reference 3: Japanese laid open Patent No. 10-85012

SUMMARY OF THE INVENTION

The present invention is carried out in view of the above-mentioned problems in order to provide a method for weaving two- or three-layered beaded fabrics by getting one continuous weft passed through respective beads and by forming two- or three-layered beaded structure.

The above-mentioned objectives of the present invention are solved by a method described in (1) or (2), or by a beaded fabric described in (3).

(1) A method for weaving a two-layered fabric based on a one-layered beaded fabric, wherein a method for weaving the one-layered beaded fabric comprises steps of: (A) arranging a plurality of warps in parallel; (B) tying an end of a weft around a first warp; (C) putting a first row of beads between respective two neighboring warps; (D) getting the weft passed through center holes of the beads in a forward direction so as to be passed under the warps successively; (E) being turned the weft around the last warp upward; (F) getting the weft passed through center holes of the beads in a backward direction so as to be passed above the warps successively; (G) being turned the weft around the first warp downward; (H) putting a second row of beads between the two neighboring warps; (I) repeating steps from (D) to (G) so as to finish the second row; and (J) repeating steps from (H) to (I) for weaving further rows, wherein: a unit procedure for weaving a two-layered beaded fabric structure comprises steps of: (K) arranging upper and lower beads between two neighboring warps instead of one bead in the middle of step (D) at any desired warp; (L) getting the weft passed through the center hole of the lower bead in the forward direction; (M) getting the weft passed through the center hole of the upper bead in the backward direction after being turned around the latter warp upward; (N) getting the weft passed through the center hole of the lower bead in the forward direction after being turned around the former warp downward; and (O) getting the weft passed through the center hole of the upper bead in the backward direction after turning around the last warp upward, wherein the two-layered beaded fabric is woven by repeating the unit procedure comprising steps (K) to (O) between the desired neighboring warps.

(2) A method for weaving a three-layered fabric based on a one-layered beaded fabric, wherein a method for weaving said one-layered beaded fabric comprises steps of: (A) arranging a plurality of warps in parallel; (B) tying an end of a weft around a first warp; (C) putting a first row of beads between respective two neighboring warps; (D) getting the weft passed through center holes of the beads in a forward direction so as to be passed under the warps successively; (E) being turned the weft around the last warp upward; (F) getting the weft passed through center holes of the beads in a backward direction so as to be passed above the warps successively; (G) being turned the weft around the first warp downward; (H) putting a second row of beads between the two neighboring warps; (I) repeating steps from (D) to (G) so as to finish the second row; and (J) repeating steps from (H) to (I) for weaving further rows, wherein: a unit procedure for weaving a three-layered beaded fabric structure comprises steps of: (K) arranging upper, middle and lower beads between two neighboring warps instead of one bead in the middle of step (D) at any desired warp; (L) getting said weft passed through the center hole of the lower bead in the forward direction; (M) getting the weft passed through the center hole of the middle bead in the backward direction after being turned around the latter warp upward; (N) getting the weft passed through the center hole of the upper bead in the forward direction after being turned around the former warp upward; (O) getting the weft passed through the center hole of the middle bead in the backward direction after being turned around the latter warp downward; (P) getting the weft passed through the center hole of the lower bead in the forward direction after being turned around the former warp downward; and (Q) getting the weft passed through the center hole of the upper bead in the backward direction after turning around the last warp upward, wherein the three-layered beaded fabric is woven by repeating the unit procedure comprising steps (K) to (Q) between the desired neighboring warps.

(3) A plurality of layered beaded fabric obtained by the method according to (1) or (2).

The present invention can provide beaded fabrics having protruded figures or three-dimensional patterns thereon, which give us quite rich flavors, by weaving two- or three-layered beads partially in weaving fabric by getting one weft passed through beads held by a plurality of stretched warps, in accordance with desired figures or patterns.

Various beaded fabrics having different patterns can be provided by employing different patterned and colored beads. Further, a wide variety of beaded fabrics can be provided by weaving three-layered beads into two-layered beaded fabrics.

If necessary, beads may be increased to four-layered or more, so that beaded fabrics can be used in various ways.

BRIEF DESCRIPTION OF THE DRAWINGS

FIG. 1-2 is perspective views illustrating the intermediate weaving steps (f)-(j) of the two-layered beaded fabric succeeding the step (e) in FIG. 1-1.

FIG. 1-3 is perspective views illustrating the latter weaving steps (k)-(o) of the two-layered beaded fabric succeeding the step (j) in FIG. 1-2.

FIG. 2-1 is perspective views illustrating the initial weaving steps (a)-(d) of a three-layered beaded fabric.

FIG. 2-2 is perspective views illustrating the intermediate weaving steps (e)-(h) of the three-layered beaded fabric succeeding the step (d) in FIG. 2-1.

FIG. 2-3 is perspective views illustrating the latter weaving steps (i)-(k) of the three-layered beaded fabric succeeding the step (h) in FIG. 2-2.

FIG. 3 is views of a two-layered beaded fabric woven by a series of steps (a)-(o) in FIGS. 1-1, 1-2 and 1-3: wherein (a) is a perspective view, (b) is a sectional view along A-A in the perspective view (a) and (c) is a side view viewed from line B-B in the perspective view (a).

DETAILED DESCRIPTION OF THE PREFERRED EMBODIMENTS

Hereinafter, the preferred embodiments by the present invention are explained in detail as referring to drawings.

Embodiment

Figure 5:
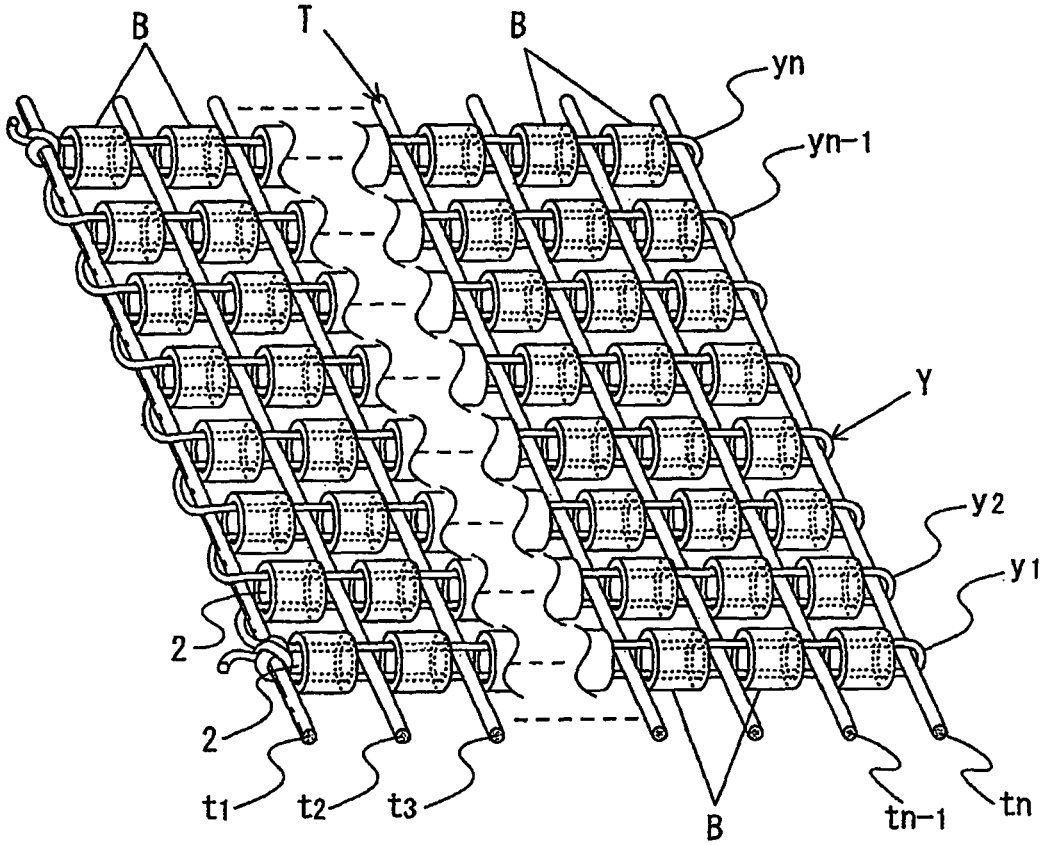
FIG. 5 is a perspective view illustrating a basic weaving procedure of the present invention.

To begin with, the basic weaving procedure of a beaded fabric is explained as referring to FIG. 5.

Character "T" designates a set of warps $t_1, t_2, t_3, \ldots t_n$ arranged in parallel. In the same manner, character "Y" designates a set of wefts $y_1, y_2, y_3, \ldots y_n$ arranged in parallel. Character "B" designates a plurality of beads having center holes 2, through which the respective wefts $y_1, y_2, y_3, \ldots y_n$ get passed by a needle (not shown), so that the beads are woven among the respective warps $t_1, t_2, t_3, \ldots t_n$.

Hereinafter, the basic weaving procedure is explained more specifically. An end of the first weft $y_1$ is tied around the first warp $t_1$ so as to fix the end. The first weft $y_1$ gets passed thorough center holes 2 of (n−1) pieces of the beads B, which are respectively arranged between the two neighboring warps, in a forward direction (in a right direction in FIG. 5, hereinafter referred as "forward procedure"). The first weft $y_1$ is turned around the last warp $t_n$ and get passed through the center holes 2 of (n−1) pieces of the beads B in a backward direction (in a left direction in FIG. 5, hereinafter referred as "backward procedure") to the first warp $t_1$ such that the respective warps $t_2, t_3, \ldots t_{n-1}$ are arranged between the forward weft $y_1$ and the backward weft $y_1$, so that the beaded weft $y_1$ is obtained. The weft $y_1$ is turned around the first warp downward and get passed through the center hole 2 of the bead B in a second row. As a result, the remaining unused part of the first weft $y_1$ is used as the second weft $y_2$, which is woven in the same manner as the first weft $y_1$.

The same forward and backward procedures explained above are repeatedly applied up to the last weft $y_n$.

In this manner, one-layered beaded fabric, in which beads B are arranged flatly all over the fabric, is obtained.

Figure 1:
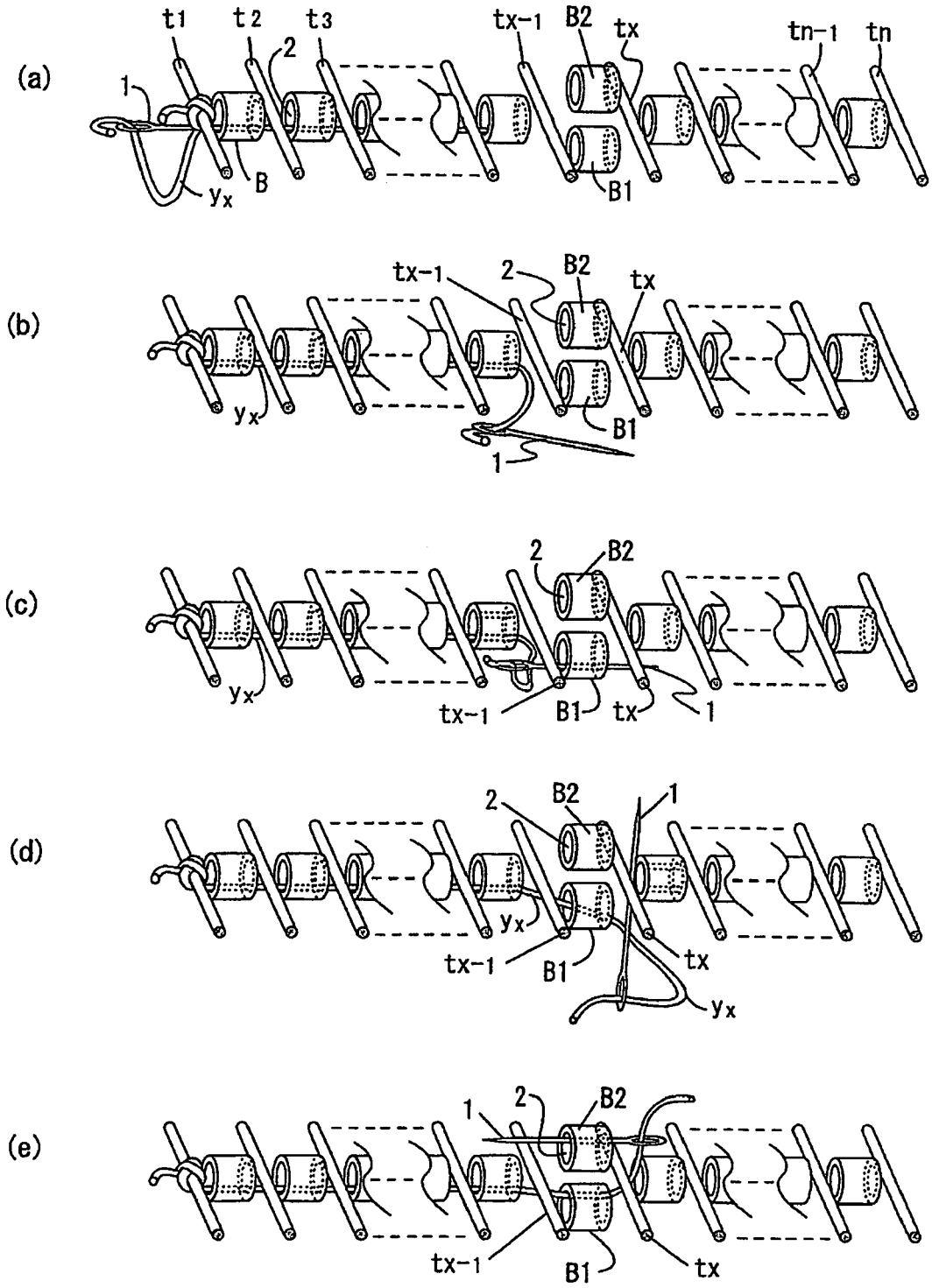
FIG. 1-1 is perspective views illustrating the initial weaving steps (a)-(e) of a two-layered beaded fabric.
Figures 1, 2:
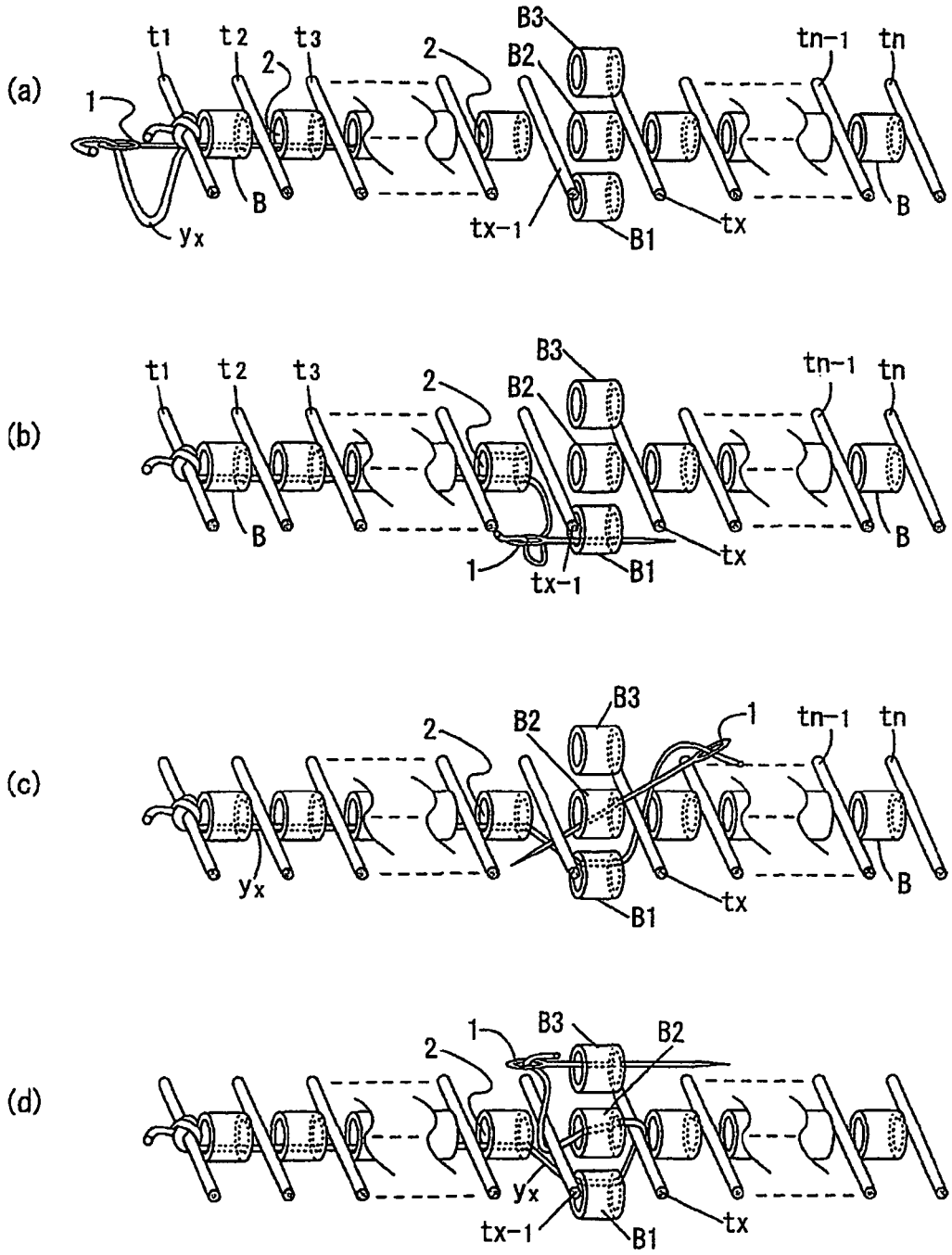
Figure 2:
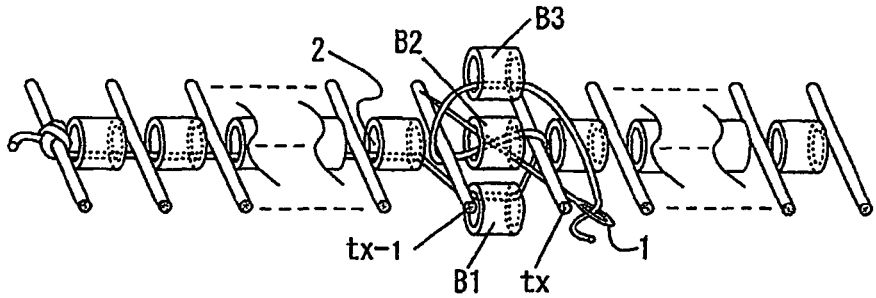
Figure 2:
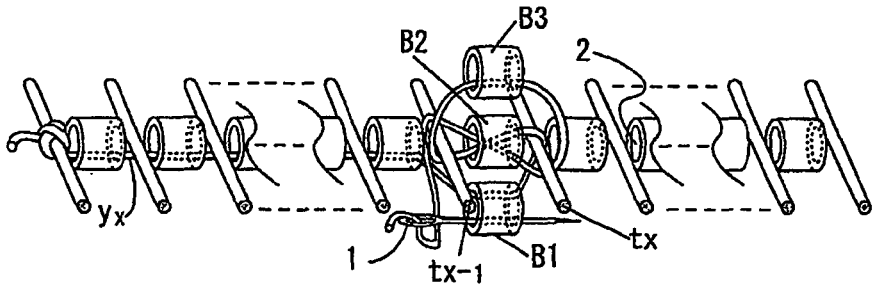
Figure 2:
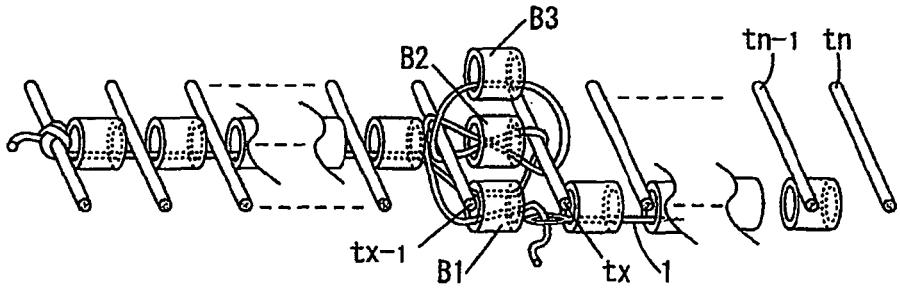
Figure 2:
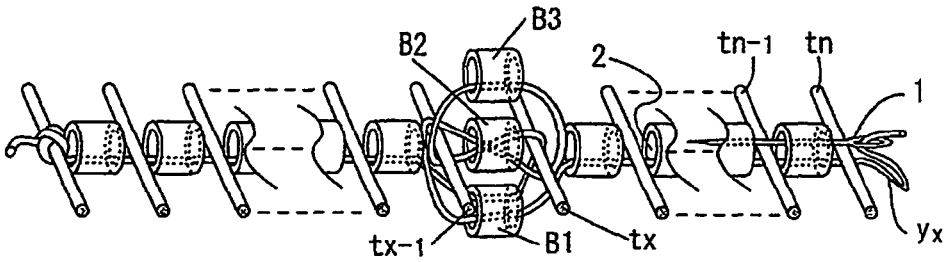

Hereinafter, a weaving method of the two-layered beaded fabric is explained as referring to FIGS. 1-1, 1-2 and 1-3.

In the middle of the forward procedure of the xth weft $y_x$ in the one-layered beaded fabric, two beads B1 and B2 are prepared instead of one bead (step (a)). The weft $y_x$ gets passed through the center hole 2 of the bead B1 arranged below the warps $t_{x-1}$ and $t_x$ in the forward direction by utilizing a needle 1 (steps (b) and (c)), and the weft $y_x$ gets passed through the center hole 2 of the bead B2 arranged above the warp $t_{x-1}$ and $t_x$ in the backward direction (step (f)) after being turned around the warp $t_x$ upward (steps (d) and (e)). Then the weft $y_x$ is turned around the warp $t_{x-1}$ downward (step (g)) and gets passed through the center hole of the bead B1 in the forward direction (steps (h) and (i)). After the weft $y_x$ gets passed through the center hole of the bead B1 second time, the same forward procedure and backward procedure are performed as in the one-layered beaded fabric (steps (j), (k) and (l)). In the middle of the backward procedure, the weft $y_x$ gets passed through the center hole 2 of the bead B2 arranged above the warp $t_x$ and $t_{x-1}$ in the backward direction (steps (m) and (n)), and then the backward procedure returns to the normal procedure (step (o)) as in the one-layered beaded fabric illustrated in FIG. 5.

The number of two-layered portions can be increased freely by repeating the same procedure explained above.

Figure 3:
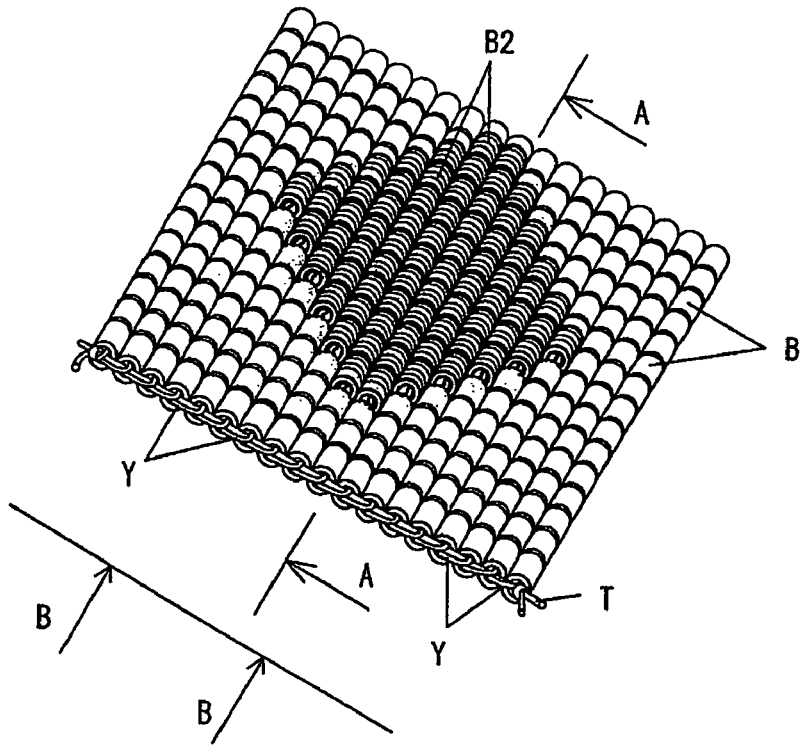
Figure 3:
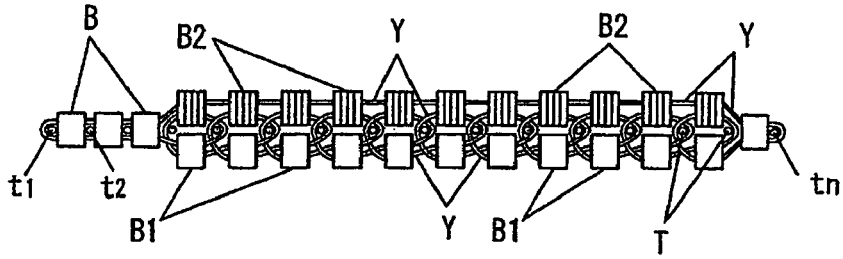
Figure 3:
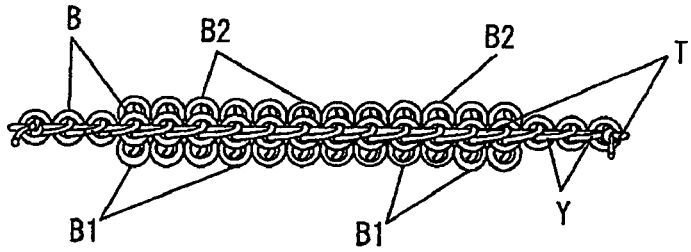

When the same procedures are repeated continuously for weaving $y_1, y_2, y_3, \ldots$, a two-layered beaded fabric with a three-dimensional pattern, for example illustrated in FIG. 3 (*a*), is obtained. Various three-dimensionally patterned fabrics with rich flavors can be obtained by changing sizes, colors, materials and the like.

Hereinafter a weaving method of the three-layered beaded fabric is explained as referring to FIGS. 2-1, 2-2 and 2-3.

In the middle of the forward procedure of the xth weft $y_x$ in the one-layered beaded fabric, three beads B1, B2 and B3 are prepared instead of one bead (step (a)). The weft $y_x$ gets passed through the center hole 2 of the bead B1 arranged below the warps $t_{x-1}$ and $t_x$ in the forward direction by utilizing the needle 1 (steps (b)). And the weft $y_x$ gets passed through the center hole 2 of the bead B2 arranged between the warp $t_{x-1}$ and $t_x$ in the backward direction after being turned around the warp $t_x$ upward (step (c)). Then the weft $y_x$ is turned around the warp $t_{x-1}$ upward and gets passed through the center hole of the bead B3 in the forward direction (step (d)).

The weft $y_x$ gets passed through the center hole of the bead B2 in the backward direction after being turned around the warp $t_x$ downward (step (e)). And the weft $y_x$ gets passed thorough the center hole of the bead B1 in the forward direction (step (g)) after being turned around the warp $t_{x-1}$ downward (step (f)). In this way a three layered beaded structure comprising beads B1, B2 and B3 is formed.

After the weft $y_x$ get passed through the bead B1 second time, the same forward procedure and backward procedure are performed as in the one-layered beaded fabric (steps (g) and (h)). The backward procedure is performed after the weft $y_x$ is turned around the last warp $t_n$ upward (step (h)). In the middle of the backward procedure, the weft $y_x$ gets passed through the center hole of the bead B3 arranged above the warp $t_x$ and $t_{x-1}$ in the backward direction (step (i), and then the backward procedure returns to the normal procedure (steps (j) and (k)) as in the one-layered beaded fabric illustrated in FIG. 5.

Figure 4:
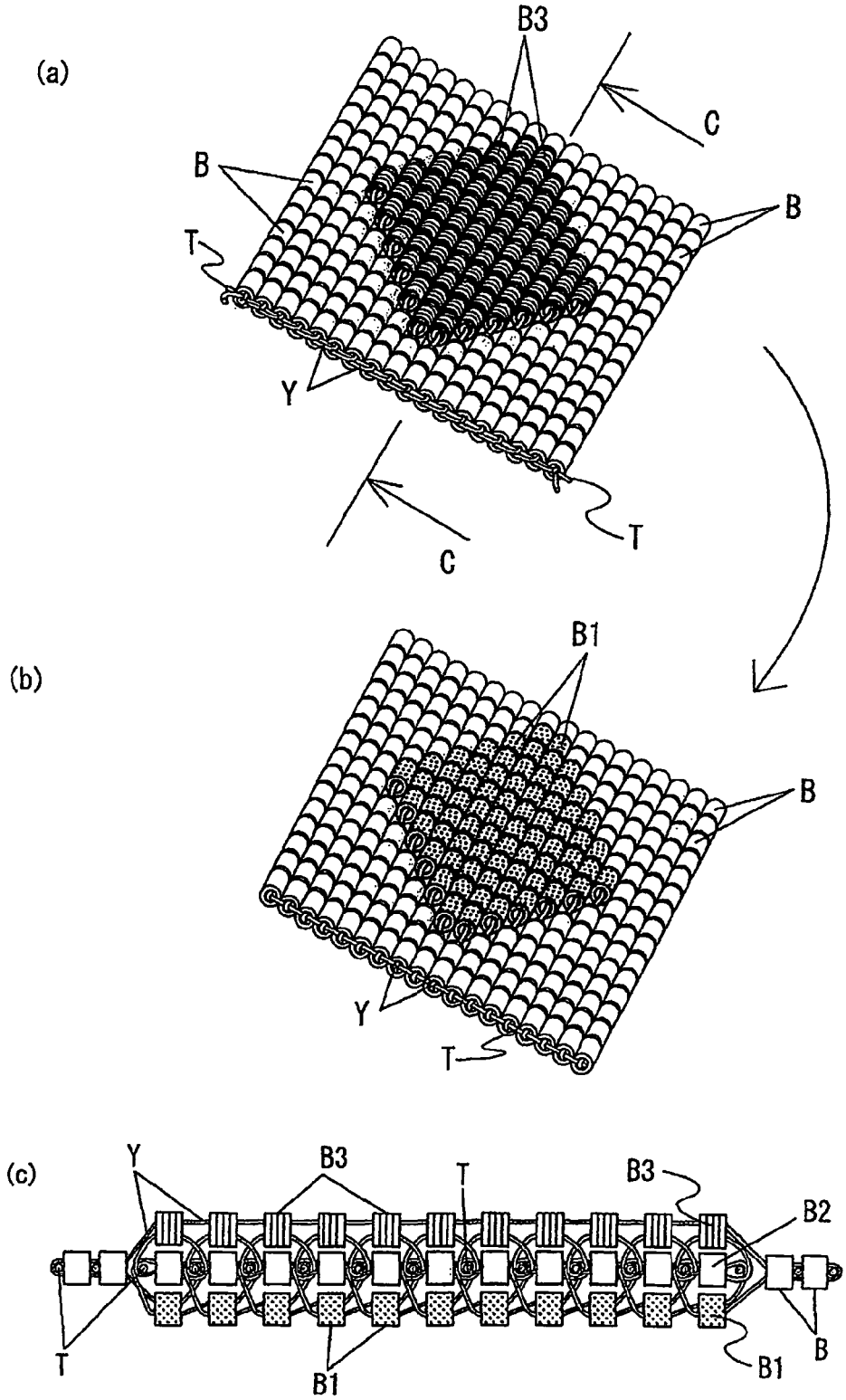
FIG. 4 is views of a three-layered beaded fabric woven by a series of steps (a)-(h) in FIGS. 2-1, 2-2 and 2-3: wherein (a) is a perspective view, (b) is a perspective view of the rear side of the perspective view (a) and (c) is a sectional view along C-C in the perspective view (a).

When the same procedures are repeated continuously for weaving $y_1, y_2, y_3, \ldots$, a three-layered beaded fabric with a three-dimensional pattern, for example, as illustrated in FIG. 4 (*a*) is obtained.

The above-explained methods for two-layered beaded fabric and three-layered beaded fabric can be combined. It is possible to provide even a four-layered beaded fabric and a five-layered beaded fabric by applying the same procedures explained above.

[Reference Character]

T ($t_1, t_2, t_3, \ldots t_n$) warp

Y ($y_1, y_2, y_3, \ldots y_n$) weft

B, B1, B2, B2 bead

1 needle

2 center hole (of the bead)

What is claimed is:

1. A method for weaving two-layered beaded patterns into one-layered beaded fabric, wherein the method for weaving said one-layered beaded fabric is comprised of the following steps:

(A) arranging a plurality of warps in parallel;

(B) tying an end of a weft around a first warp;

(C) putting a first row of beads in spaces between neighboring warps;

(D) passing said weft through center holes of said beads in a forward direction so as to be passed under said warps successively;

(E) turning said weft upward around the last warp;

(F) passing said weft through the center holes of said beads in a backward direction so as to be passed above said warps successively;

(G) turning said weft downward around the first warp;

(H) putting in a second row of beads in the spaces between neighboring warps;

(I) repeating steps from (D) to (G) so as to finish the second row; and (J) repeating steps from (H) to (I) for weaving further rows, wherein; a unit procedure for weaving a two-layered beaded fabric structure into said one layered fabric is comprised of the following steps:

(K) arranging upper and lower beads between two neighboring warps, a former and a latter, instead of one bead in the middle of step (D) at any desired warp;

(L) passing said weft through the center hole of said lower bead in the forward direction;

(M) turning said weft upward around the latter warp and then passing the weft through a center hole of said upper bead in the backward direction;

(N) turning said weft downward around the former warp and then passing the weft through a center hole of said lower bead in the forward direction; and (O) turning said weft upward around the last warp and then passing the weft through a center hole of said upper bead in the backward direction, wherein said two-layered beaded fabric is woven by repeating said unit procedure comprising steps (K) to (O) between the desired neighboring warps.

2. A method for weaving three-layered beaded patterns into one-layered beaded fabric, wherein a method for weaving said one-layered beaded fabric is comprised of the following steps:

(A) arranging a plurality of warps in parallel;

(B) tying an end of a weft around a first warp;

(C) putting in a first row of beads in the spaces between neighboring warps;

(D) passing said weft through the center holes of said beads in a forward direction so as to be passed under said warps successively;

(E) turning said weft upward around the last warp;

(F) passing said weft through the center holes of said beads in a backward direction so as to be passed above said warps successively;

(G) turning said weft downward around the first warp;

(H) putting in a second row of beads in the spaces between neighboring warps;

(I) repeating steps from (D) to (G) so as to finish the second row; and (J) repeating steps from (H) to (I) for weaving further rows, wherein: a unit procedure for weaving a three-layered beaded fabric structure into said one layered fabric is comprised of the following steps:

(K) arranging upper, middle and lower beads between two neighboring warps, a former and a latter, instead of one bead in the middle of step (D) at any desired warp;

(L) passing said weft through the center hole of said lower bead in the forward direction;

(M) turning said weft upward around the latter warp and then passing the weft through a center hole of said middle bead in the backward direction; (N) turning said weft upward around the former warp and then passing the weft through a center hole of said upper bead in the forward direction;

(O) turning said weft downward around the latter warp and then passing the weft through a center hole of said middle bead in the backward direction;

(P) turning said weft downward around the former warp and then passing the weft through a center hole of said lower bead in the forward direction; and (Q) turning said weft upward around the last warp and then passing the weft through a center hole of said upper bead in the backward direction, wherein said three-layered beaded fabric is woven by repeating said unit procedure comprising steps (K) to (Q) between the desired neighboring warps.

3. A plurality of layered beaded fabric obtained by the method according to claim 1.

4. A plurality of layered beaded fabric obtained by the method according to claim 2.

* * * * *